US006779441B2

(12) United States Patent
Jun

(10) Patent No.: US 6,779,441 B2
(45) Date of Patent: Aug. 24, 2004

(54) AUTOMATIC METAL PRINTER

(76) Inventor: Sung Boung Jun, 3-92 Chung-Hak Dong, Youn Soo Gu, Incheon-City (KR)

( * ) Notice: Subject to any disclaimer, the term of this patent is extended or adjusted under 35 U.S.C. 154(b) by 0 days.

(21) Appl. No.: 10/361,181

(22) Filed: Feb. 10, 2003

(65) Prior Publication Data

US 2004/0083870 A1 May 6, 2004

(30) Foreign Application Priority Data

Nov. 4, 2002 (KR) ..... 10-2002-0067709

(51) Int. Cl.[7] ..... B26B 7/00

(52) U.S. Cl. ..... 101/3.1; 101/19; 400/124.16; 83/30; 83/533; 83/575; 83/577; 29/34 R

(58) Field of Search ..... 400/124.01, 124.16, 400/124.17, 124.18; 101/3.1, 19; 83/875, 30, 752, 524, 533, 575, 576, 577, 531, 534; 29/34 R, 38 C, 56, 47

(56) References Cited

U.S. PATENT DOCUMENTS 5,682,657 A * 11/1997 Hirose ..... 29/33 J
5,775,215 A * 7/1998 Hirate ..... 101/4
5,785,436 A * 7/1998 Harrison et al. ..... 400/124.01
5,820,006 A * 10/1998 Turner ..... 225/96
5,924,350 A * 7/1999 Helinski ..... 83/575
6,033,138 A * 3/2000 Kerr ..... 400/328
6,478,206 B2 * 11/2002 Shimotoyodome et al. .... 225/2

FOREIGN PATENT DOCUMENTS

KR 183577 11/2002

* cited by examiner

*Primary Examiner*—Andrew H. Hirshfeld
*Assistant Examiner*—Kevin D. Williams
(74) *Attorney, Agent, or Firm*—Park & Sutton LLP; John K. Park

(57) ABSTRACT

Disclosed is an automatic metal printer which prints a camera-photographed and computer-processed image on a surface of a hard material, such as a metal sheet, through a dot matrix printing type method wherein brightness of the printed image is expressed in accordance with density of dots in the dot matrix formed on the surface of the hard material. The automatic metal printer includes a platform which reciprocates forward and rearward in a lower portion of a body by a motor-operated first ball screw. A saddle is installed at a position above the platform so as to reciprocate to the left and right in the body by a motor-operated second ball screw. A dotter is vertically installed on the saddle so as to dot the upper surface of the hard material seated on the platform to print a desired image.

4 Claims, 4 Drawing Sheets

AUTOMATIC METAL PRINTER

CLAIMING FOREIGN PRIORITY

The applicant claims and requests a foreign priority, through the Paris Convention for the Protection of Industry Property, based on a patent application filed in the Republic of Korea (South Korea) with the filing date of Nov. 4, 2002, with the application number 10-2002-0067709, by the applicant.

BACKGROUND OF THE INVENTION

1. Field of the Invention

The present invention relates, in general, to automatic metal printers which print an image on a hard material, such as a metal or plastic sheet, in accordance with data produced from a camera-photographed image processed through a computer program and, more particularly, to an automatic metal printer designed to print a photographed image on a surface of a hard material through a dot matrix printing type method wherein the surface of the hard material is dotted by a dotter.

2. Description of the Prior Art

In the prior art, a desired image is printed on a surface of a metal sheet by cutting the metal surface using a cutting tool installed on a CNC cutting machine or an end mill. However, the cutting process of printing an image on a metal surface using the cutting tool is problematic in that it consumes excessive time and generates dust and chips while printing.

In an effort to overcome the problem of the conventional metal printing process, a three-dimensional metal printer has been proposed, as disclosed in Korean Utility Model Registration No. 183,577. During a printing process using the conventional three-dimensional metal printer, a tool or a metal material is moved in three directions, that is, X-axial, Y-axial and Z-axial directions, and, a rough-cutting spindle and a fine-cutting spindle are sequentially rotated to roughly and finely cut the metal surface to produce an image on the surface within a short period of time.

However, the conventional three-dimensional metal printer uses a cutting process to print an image on a metal surface, so the metal printer generates dust and chips during the rough-cutting process and the fine-cutting process, and fails to produce a precise image on the metal surface. In addition, the three-dimensional metal printer must be provided with a belt transmission mechanism comprising belts and pulleys to transmit rotating force to the spindles, thereby undesirably having a complex construction.

Another problem of the conventional metal printers including the three-dimensional metal printer resides in that it is necessary for a user to manually load and unload metal materials on and from a printing position of a printer, thus increasing time consumption and sometimes causing safety hazards while printing.

SUMMARY OF THE INVENTION

Accordingly, the present invention has been made keeping in mind the above problems occurring in the prior art, and provides an automatic metal printer which prints an image on a surface of a hard material, such as a metal sheet, through a dot matrix printing type method, completely different from printing methods used in conventional metal printers.

That is, an object of the present invention is to provide an automatic metal printer which prints a photographed image on a surface of a hard material through a dot matrix printing type method wherein the surface of the hard material is dotted by a diamond-tipped dotter and a desired image is produced in accordance with density of dots in the dot matrix formed on the surface of the hard material, and which thus prints a precise image on the surface of the hard material and desirably reduces time consumption while printing.

Another object of the present invention is to provide an automatic metal printer which has a means for automatically loading and unloading hard materials on and from a printing position, thus being completely automated.

In order to accomplish the above objects, the present invention provides an automatic metal printer, comprising: a platform reciprocating forward and rearward in a lower portion of a body by a motor-operated first ball screw, with a seat depression formed at a middle portion of an upper surface of the platform to seat thereon a hard material to be printed with an image by the printer; a saddle installed at a position above the platform so as to reciprocate to the left and right in the body by a motor-operated second ball screw; and a dotter vertically installed on the saddle so as to dot an upper surface of the hard material seated on the platform to print the image on the surface of the hard material, the dotter comprising: a diamond tip vertically installed at a lower portion of a front surface of the saddle while being biased by a spring so as to reciprocate upward and downward; and a solenoid actuator vertically installed at the front surface of the saddle such that a plunger of the solenoid actuator comes into contact with an upper surface of the diamond tip and repeatedly pushes the upper surface of the diamond tip downward.

The automatic metal printer further comprises an automatic loading unit, the automatic loading unit comprising: two vertical cartridges standing upright at a rear portion of the body, and each sequentially receiving a plurality of metal materials therein; and a feeder installed at the rear portion of the body to surround lower ends of the two vertical cartridges, the feeder reciprocating to the left and right in the body by a motor-operated third ball screw so that the feeder alternately pushes metal materials stacked in the two cartridges to sequentially load the metal materials into the seat depression of the platform.

The automatic metal printer further comprises an automatic unloading unit mounted to a central portion of a front of the body such that the automatic unloading unit automatically unloads each metal material from the platform when the platform is moved forward to a predetermined position.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
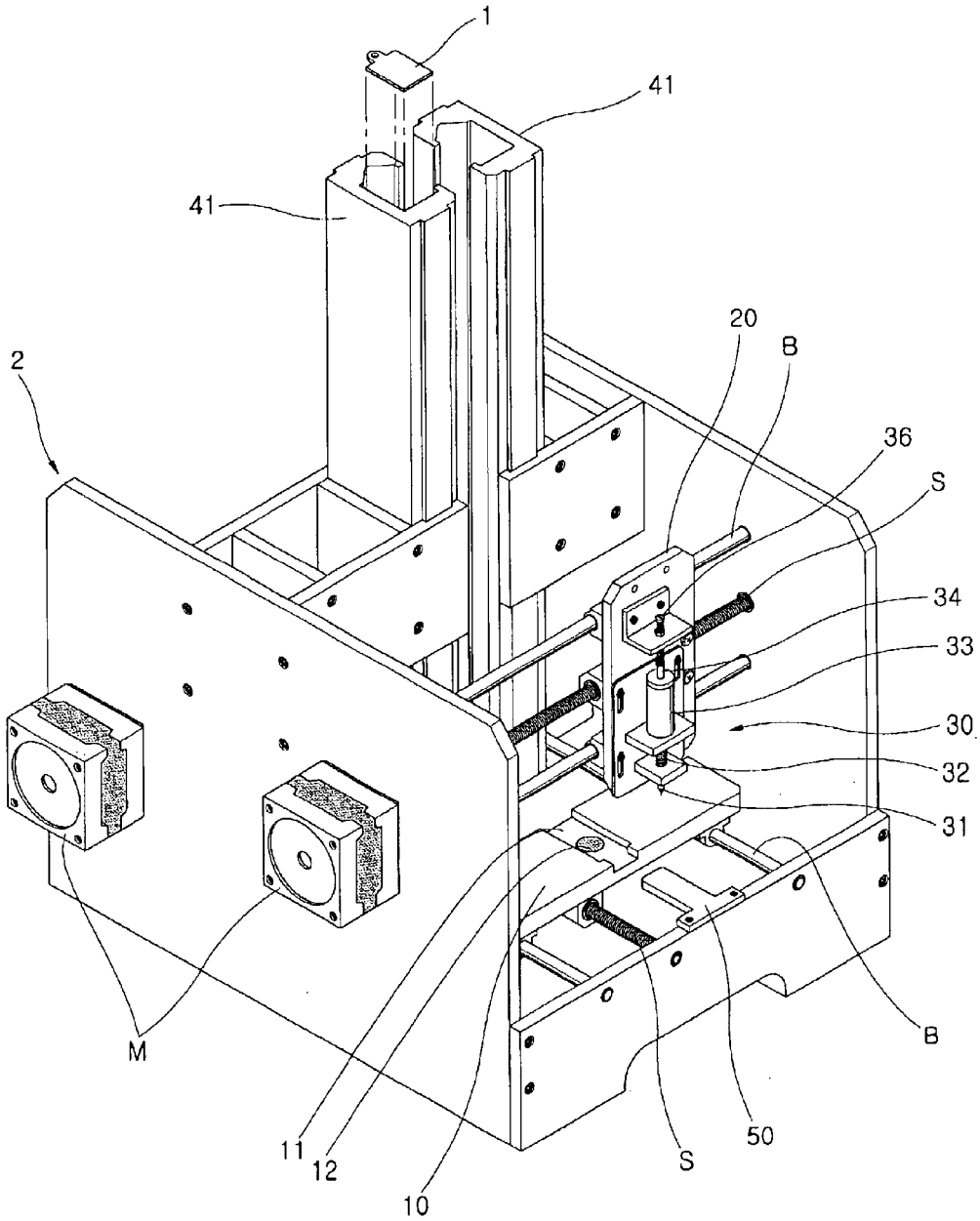
FIG. 1 is a perspective view of an automatic metal printer, according to an embodiment of the present invention.

Reference should now be made to the drawings, in which the same reference numerals are used throughout the different drawings to designate the same or similar components.

FIG. 1 is a perspective view of an automatic metal printer, according to an embodiment of the present invention. As shown in the drawing, the automatic metal printer of the present invention comprises a box-shaped metal body 2 fabricated with two higher sidewalls and lower front and rear walls. The metal body 2 defines a space therein to install a plurality of parts.

Figure 3:
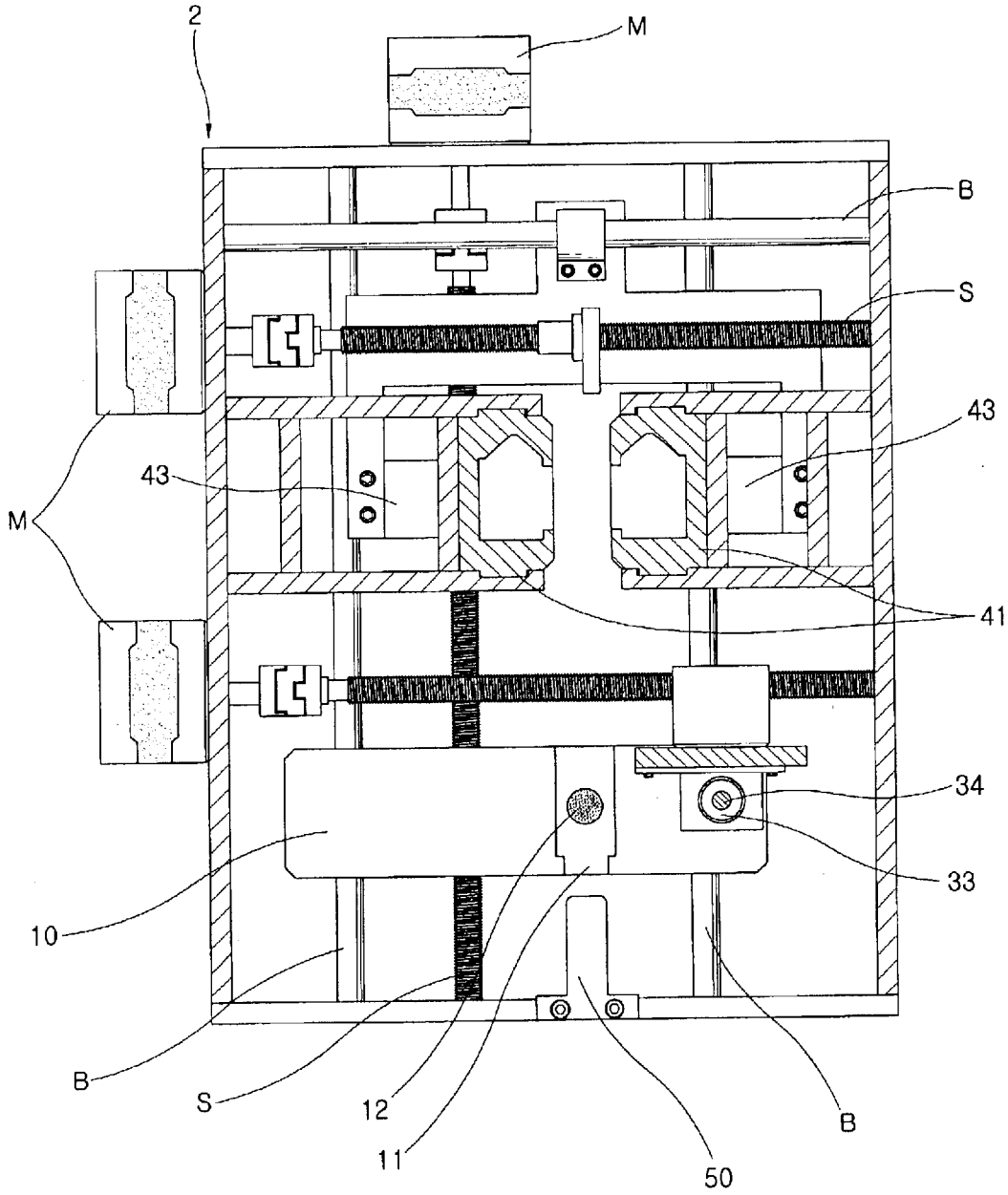
FIG. 3 is a plan sectional view showing an automatic loading unit and an automatic unloading unit included in the automatic metal printer of FIG. 1.
Figure 4:
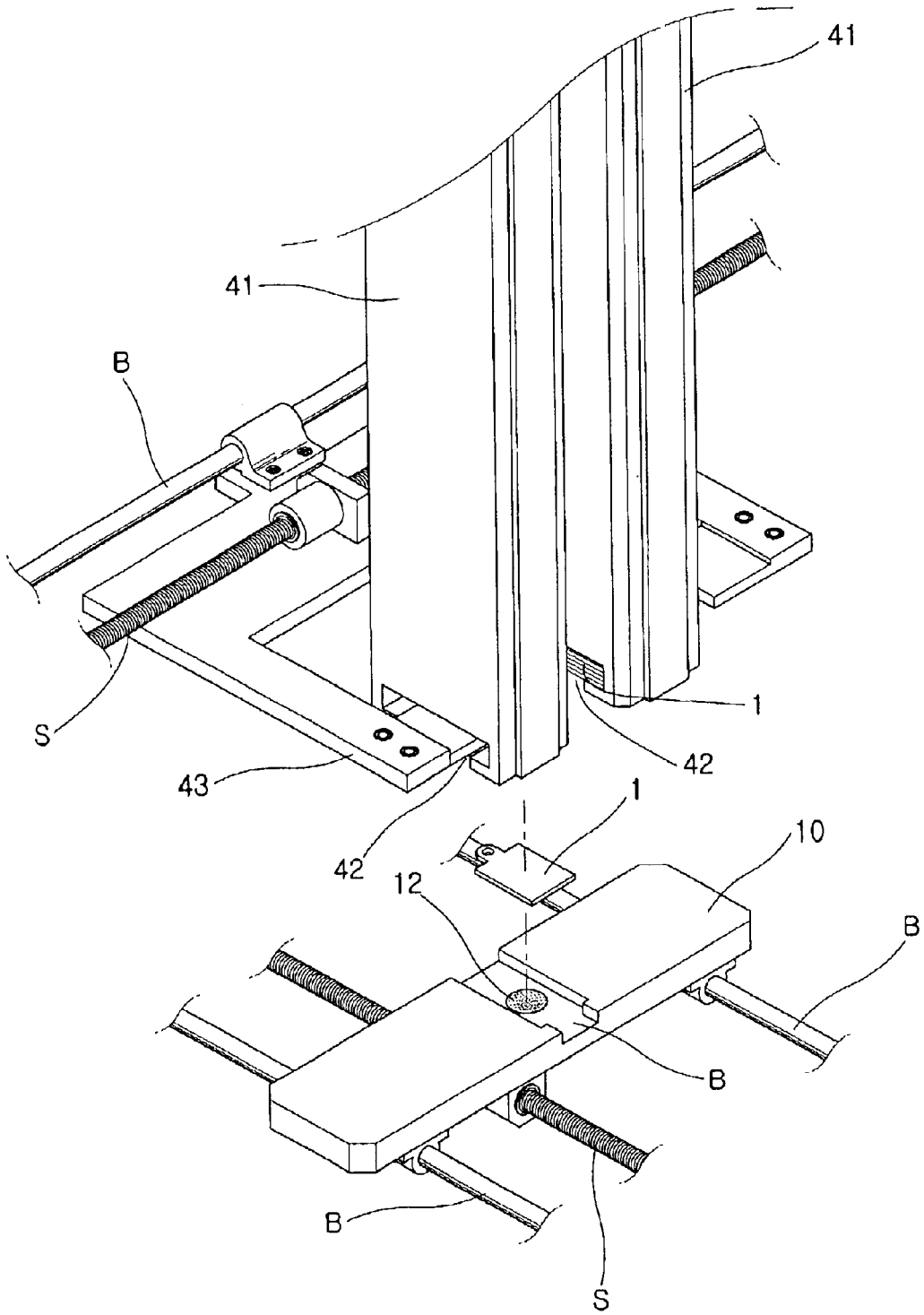
FIG. 4 is an exploded perspective view showing the operation of the automatic loading unit included in the automatic metal printer of FIG. 1.

As shown in FIGS. 3 and 4, a platform 10 is assembled with a threaded rod S of a first ball screw, which extends between the front and rear walls of the body 2 in a longitudinal direction and is rotated by an operation of a first servomotor M exteriorly mounted to the rear wall of the body 2. The platform 10 is also movably fitted over two first guide bars B longitudinally extending on opposite sides of the threaded rod S of the first ball screw, thus being longitudinally reciprocated by a rotation of the threaded rod S to move forward and rearward under the guidance of the first guide bars B. A seat depression 11 is formed at a middle portion of the upper surface of the platform 10. Of course, the shape and size of the seat depression 11 may be appropriately changed in accordance with the shape and size of each metal material 1 to be seated on the seat depression 11 during a printing process. A magnet 12 is installed at the bottom of the seat depression 11 so as to magnetically attract the metal material 1, thus stably holding the material 1 in the seat depression 11 of the platform 10 while preventing an undesired movement of the material 1 during the printing process.

A vertical saddle 20 is assembled with a threaded rod S of a second ball screw, which extends between the two sidewalls of the body 2 in a latitudinal direction at a front portion of the body 2 and is rotated by an operation of a second servomotor M exteriorly mounted to a sidewall of the body 2. The saddle 20 is also movably fitted over two second guide bars B extending in the latitudinal direction on opposite sides of the threaded rod S of the second ball screw, thus being reciprocated in the latitudinal direction to move to the left and right while maintaining a vertical position thereof. A dotter 30 is installed on the front surface of the vertical saddle 20.

Figure 2:
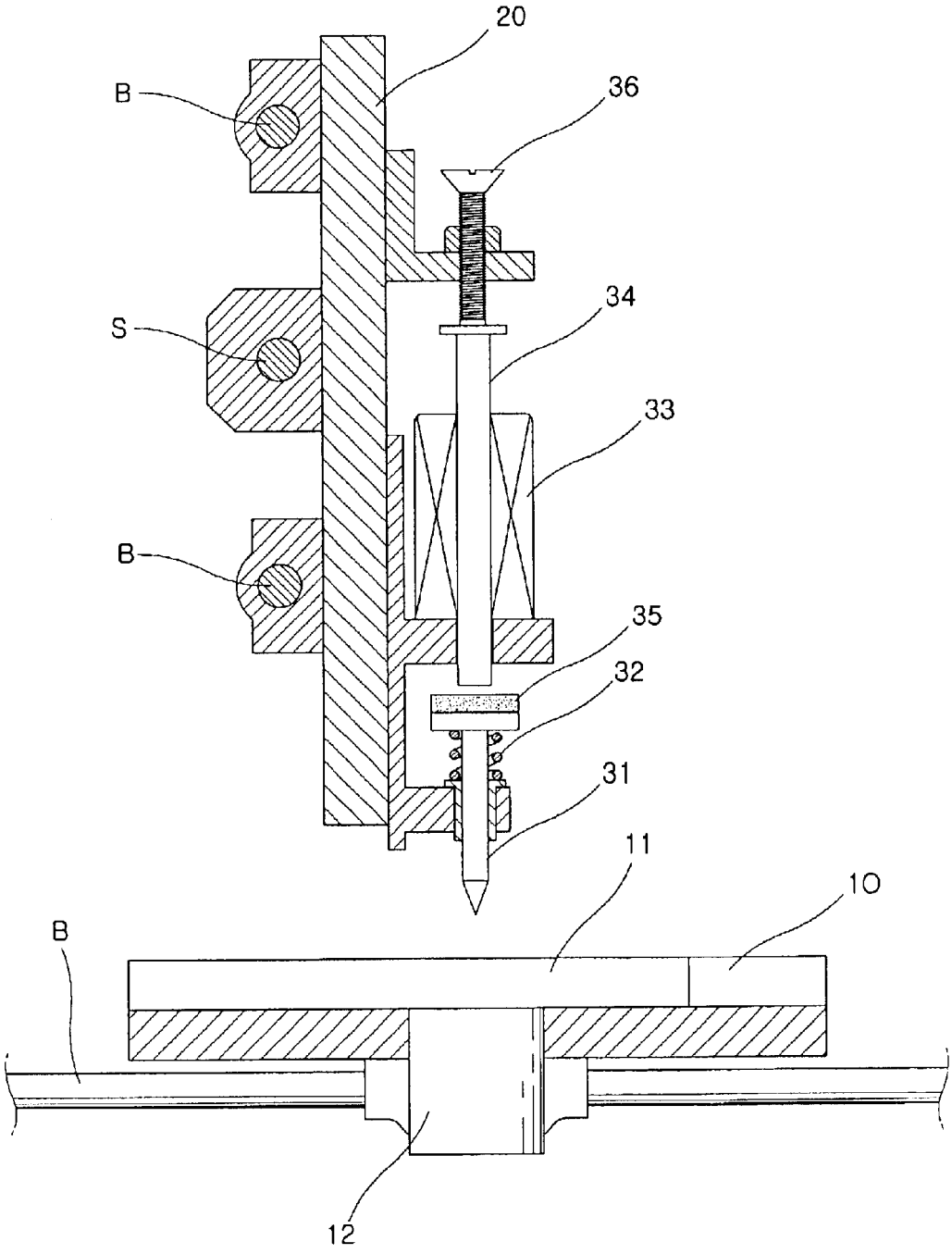
FIG. 2 is a side sectional view of a dotter included in the automatic metal printer of FIG. 1.

As shown in FIGS. 1 and 2, the dotter 30 is mounted to the vertical saddle 20 such that the dotter 30 is vertically directed toward the upper surface of the metal material 1 seated on the platform 10. The dotter 30 thus dots the upper surface of the metal material 1 to print an image on the metal material's surface through a dot matrix printing type method. The dotter 30 according to the embodiment of the present invention comprises a diamond tip 31 and a solenoid actuator 33. The solenoid actuator 33 vibrates to repeatedly push the head of the diamond tip 31 downward in a vertical direction.

The diamond tip 31 comprises a nail-shaped body, with a compression coil spring 32 fitted over the shank of the diamond tip 31, so that the tip 31 is moved downward in the vertical direction while compressing the coil spring 31 when a vibrating plunger 34 of the solenoid actuator 33 repeatedly pushes the head of the tip 31 downward in the vertical direction. The diamond tip 31 is elastically moved upward to restore its original position due to the restoring force of the compressed coil spring 32 when the pushing force of the plunger 34 is removed from the head of the tip 31. In FIG. 2, the plunger 34 of the solenoid actuator 33 is shown in a way such that it is spaced apart from the head of the diamond tip 31 for ease of description. However, it should be understood that the head of the diamond tip 31 always comes into close contact with the plunger 34 of the solenoid actuator 33 due to the spring force of the compression coil spring 32, so that the tip 31 is repeatedly pushed downward by the plunger 34 and released from the pushing force of the plunger 34 due to vibration of the plunger 34.

As shown in FIG. 2, a shock absorbing material 35, such as a soft Teflon, is preferably attached to the upper surface of the head of the diamond tip 31, thus absorbing shock when the tip 31 hits and dots the surface of the metal material 1 by vibration of the plunger 34. The shock absorbing material 35 thus effectively prevents the (plated) surface of the metal material 1 from being damaged or cracked due to instantaneous impact while dotting. A height adjusting screw 36 is preferably installed on the saddle 20 at an upper position above the solenoid actuator 33 so as to adjust the height of the plunger 34. Due to the height adjusting screw 36, it is possible for a user to easily control the height of the diamond tip 31 by adjusting the height of the plunger 34 in accordance with the thickness of the metal materials 1.

The automatic metal printer of the present invention also includes an automatic loading unit 40 comprising a cartridge 41 and a feeder 43. During a printing process of the automatic metal printer, a plurality of metal materials 1, sequentially stacked in the cartridge 41, are automatically loaded on the seat depression 11 of the platform 10 one by one by an operation of the feeder 43. In the preferred embodiment of the present invention, two vertical cartridges 41, each having a vertical channel capable of sequentially receiving the metal materials 1 therein, stand upright in parallel to each other at a rear portion of the body 2. The upper end of each vertical cartridge 41 is open to communicate with the channel, so that a predetermined number of metal materials 1 are sequentially stacked in the channel. The lower end of each cartridge 41 is provided with a slit 42 at each side thereof, so that a lowermost metal material 1 is loaded from the cartridge 41 into the seat depression 11 of the platform 10 when a loading arm of the feeder 43 is laterally inserted into the cartridge 41 through the slit 42. The feeder 43 having two loading arms is positioned to surround the lower ends of the two vertical cartridges 41 which stand upright at a position above the platform 10. The feeder 43 is assembled with a threaded rod S of a third ball screw, which extends between the two sidewalls of the body 2 in a latitudinal direction at a rear portion of the body 2 and is rotated by an operation of a third servomotor M exteriorly mounted to a sidewall of the body 2. The feeder 43 is also movably fitted over a third guide bar B extending between the two sidewalls of the body 2 in the latitudinal direction, thus being reciprocated in the latitudinal direction to move to the left and right and alternately pushing by means of the loading arms the lowermost metal materials 1 stacked in the two cartridges 41 to sequentially load the metal materials 1 into the seat depression 11 of the platform 10.

The automatic metal printer of the present invention also comprises an automatic unloading unit 50 used for automatically unloading each metal material 1 from the platform 10 after a printing process. The automatic unloading unit 50 is a T-shaped metal piece, horizontally mounted to a central portion of the upper edge of the body's front wall. When the platform 10 is moved forward to a predetermined position after a printing process, the rear pushing end of the unloading unit 50 pushes the metal material 1 rearward to automatically unload the material 1 printed with an image from the platform 10.

The automatic metal printer of the present invention is operated as follows. When the metal printer is turned on after a predetermined number of metal materials 1 are stacked in each cartridge 41, a controller of the metal printer drives the three servomotors M in accordance with data produced from a camera-photographed image processed through a computer program, thus controllably rotating the threaded rods S of the three ball screws.

When the platform 10 is thus placed at a predetermined position under the cartridges 41, the feeder 43 is moved to the left or right, so that a loading arm of the feeder 43 is laterally inserted into a cartridge 41 through the slit 42 of the cartridge 41. A metal material 1 is thus automatically loaded from the cartridge 41 into the seat depression 11 of the platform 10. After loading the metal material 1 on the platform 10, the feeder 43 pauses for a predetermined time period. When another signal indicating a loading of a new metal material 1 onto the platform 10 is outputted from the controller after unloading the metal material 1 from the platform 10, the feeder 43 is moved in the reverse direction. The other loading arm of the feeder 43 is thus laterally inserted into the other cartridge 41 to load a new metal material 1 into the empty seat depression 11 of the platform 10.

After a metal material 1 is loaded into the seat depression 11 of the platform 10 and is magnetically held by the magnet 12, the platform 10 is moved to a predetermined position under the saddle 20 until the platform 10 is stopped at a zero point calculated from data stored in the computer program.

Thereafter, the solenoid actuator 33 of the dotter 30 is operated to allow the plunger 34 to reciprocate in a vertical direction, so that the diamond tip 31 hits and dots the surface of the metal material 1. In such a case, the saddle 20 is moved in a latitudinal direction according to the data to form a dot line on the surface of the material 1. After formation of one dot line on the surface, the platform 10 moves by a predetermined pitch in a longitudinal direction, thus allowing the dotter 30 to form another dot line on the surface. The latitudinal movement of the saddle 20 and the longitudinal movement of the platform 10 are repeated until a printing process is accomplished. The automatic metal printer thus prints a camera-photographed and computer-processed image on the surface of the metal material 1 through a dot matrix printing type method wherein brightness of the printed image is expressed in accordance with density of dots in the dot matrix formed on the surface of the metal material.

After the image is completely printed on the surface of the metal material 1, the platform 10 is moved forward to a predetermined position, so that the rear pushing end of the unloading unit 50 pushes the metal material 1 rearward by the forward moving force of the platform 10, thus automatically unloading the material 1 from the seat depression 11 of the platform 10. The unloaded metal material 1 drops onto a discharging position provided at a lower portion of the body 2, and is discharged from the metal printer through a discharging passage (not shown).

As described above, the present invention provides an automatic metal printer which prints a photographed image on a surf ace of a hard material, such as a metal sheet, through a dot matrix printing type method wherein the surface of the hard material is dotted by a diamond-tipped dotter and a desired image is produced in accordance with density of dots in the dot matrix formed on the surface of the hard material. The automatic metal printer thus prints a precise image on the surface of the hard material and desirably reduces time consumption while printing.

The automatic metal printer also has a means for automatically loading and unloading hard materials on and from a printing position, thus being completely automated.

In the automatic metal printer, a shock absorbing material, such as a soft Teflon, is preferably attached to the upper surface of a diamond tip head of the dotter, thus absorbing shock when the diamond tip hits and dots the surface of a metal material by vibration of a plunger of a solenoid actuator. The shock absorbing material thus effectively prevents the (plated) surface of the metal material from being damaged or cracked due to instantaneous impact while dotting.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An automatic metal printer, comprising:

a platform reciprocating forward and rearward in a lower portion of a body by a motor-operated first ball screw, with a seat depression formed at a middle portion of an upper surface of said platform to seat thereon a hard material to be printed with an image by the printer;

a saddle installed at a position above the platform so as to reciprocate to the left and right in said body by a motor-operated second ball screw; and a dotter vertically installed on said saddle so as to dot an upper surface of the hard material seated on the platform to print the image on the surface of the hard material, said dotter comprising:

a diamond tip vertically installed at a lower portion of a front surface of said saddle while being biased by a spring so as to reciprocate upward and downward;

a solenoid actuator vertically installed at the front surface of said saddle such that a plunger of the solenoid actuator comes into contact with an upper surface of said diamond tip and repeatedly pushes the upper surface of the diamond tip downward; and an automatic loading unit, said automatic loading unit comprising:

two vertical cartridges standing upright at a rear portion of said body, and each sequentially receiving a plurality of metal materials therein; and a feeder installed at the rear portion of the body to surround lower ends of the two vertical cartridges, said feeder reciprocating to the left and right in the body by a motor-operated third ball screw so that the feeder alternately pushes metal materials stacked in the two cartridges to sequentially load the metal materials into the seat depression of the platform.

2. The automatic metal printer according to claim 1, further comprising an automatic unloading unit mounted to a central portion of a front of said body such that the automatic unloading unit automatically unloads each metal material from the platform when the platform is moved forward to a predetermined position.

3. The automatic metal printer according to claim 1, wherein a shock absorbing material is attached to the upper surface of said diamond tip.

4. The automatic metal printer according to claim 1, wherein a height adjusting screw is installed on said saddle at an upper portion above the solenoid actuator so as to adjust a height of said plunger.

* * * * *